US006408480B1

(12) United States Patent
Wiemann

(10) Patent No.: US 6,408,480 B1
(45) Date of Patent: Jun. 25, 2002

(54) POLISHING DISK

(76) Inventor: Martin Wiemann, Am Hendelberg 20, D-65375 Oestrich-Winkel (DE)

( * ) Notice: Subject to any disclaimer, the term of this patent is extended or adjusted under 35 U.S.C. 154(b) by 0 days.

(21) Appl. No.: 09/400,741

(22) Filed: Sep. 21, 1999

(30) Foreign Application Priority Data

Sep. 21, 1998 (DE) ..... 198 43 267

(51) Int. Cl.[7] ..... A47L 11/02; A47L 11/164

(52) U.S. Cl. ..... 15/230.12; 15/230.15; 15/230.19

(58) Field of Search ..... 15/230, 230.12, 15/230.15, 230.19

(56) References Cited

U.S. PATENT DOCUMENTS

| | | | | | |
|---|---|---|---|---|---|
| 2,329,222 | A | * | 9/1943 | Schlegel, Jr. | 15/230.12 |
| 2,961,681 | A | * | 11/1960 | Terzian | 15/230 |
| 3,007,189 | A | * | 11/1961 | Crane | 15/230 |
| 3,075,222 | A | * | 1/1963 | Miller | 15/230.12 |
| 3,086,821 | A | * | 4/1963 | Kent | 15/230.12 |
| 3,430,283 | A | * | 3/1969 | Engel | 15/230.12 |
| 3,537,122 | A | * | 11/1970 | Proffitt, Jr. | 15/230.12 |
| 4,149,294 | A | * | 4/1979 | MacKay, Jr. | 15/230.12 |
| 4,758,290 | A | * | 7/1988 | McMakin | 15/230.12 |
| 5,142,727 | A | * | 9/1992 | Koester | 15/230 |
| 5,893,191 | A | * | 4/1999 | Schneider | 15/230.12 |
| 6,081,959 | A | * | 7/2000 | Umbrell | 15/230.12 |
| 6,088,871 | A | * | 7/2000 | Kobayashi | 15/230.12 |

FOREIGN PATENT DOCUMENTS

| | | |
|---|---|---|
| DE | 1 577 602 | 2/1970 |

* cited by examiner

*Primary Examiner*—Randall E. Chin

(57) ABSTRACT

Polishing disk with short fiber pile layer with strong binding in a holding layer. A burr adhesion layer is installed on the back side of the polishing disk.

8 Claims, 1 Drawing Sheet

POLISHING DISK

FIELD OF THE INVENTION

Cross-References to Related Applications

Not applicable.

Statement Regarding Federally Sponsored Research or Development

Not applicable.

BACKGROUND OF THE INVENTION

The invention relates to a polishing disk for polishing surfaces such as varnish coatings of cars, and particularly to polishing disks for the automobile industry.

BACKGROUND OF THE INVENTION

Polishing disks are known in various designs, including felt disks, foam material disks, and lambskin pieces.

A large field of application for polishing devices in the automobile industry. Newly produced cars are polished in final processing; during machine polishing, polishing striations, so-called rainbow holograms, appear and are undesired. Polishing should therefore take place without such "rainbow holograms".

SUMMARY OF THE INVENTION

It is an object of the invention to provide a polishing disk which is particularly suitable for polishing surfaces which are to be free from these "rainbow holograms".

It is a further object of the invention to provide a polishing disk which can withstand a few washing processes without distorting and swelling up.

It is still another object of the invention to provide a polishing disk which is sufficiently resilient to follow the curvature of surfaces to be polished.

According to the invention, a fiber pile layer, a holding layer and a backside layer are provided.

The holding layer is preferably in circular form, and confers on the disk a certain shape stability, but with sufficient flexibility in order to adapt to surfaces which are to be polished. The holding layer can be made up dependent upon the structure of the fiber layer, as a woven backing, or a foam material backing or a tuft backing. The fiber layer itself is constituted like velvet or velour, with a smooth or ribbed surface, i.e., the fibers stand very densely and the fiber ends are very uniformly distributed over the surface, even when the fibers themselves emerge from the holding layer in bundles. The individual fibers are themselves very thin, but without a tendency to shed fluff. Uniform fibers of relatively high tear strength and of uniform thickness are used. The fiber pile can be in the range of 2 through 10 mm long. The fiber pile is produced so that the polishing disk can be washed in a washing machine, so as to represent a multiple-use product.

The polishing disk is provided on its back side with a hook and loop fastener half such as Velcro velour layer, a gauze fabric, or a felt layer, so that the polishing disk can be fastened to a corresponding hook and loop fastener half on a pad. The polishing disk can be used with a polishing machine, particularly an angle polishing machine, but it can also be used by hand. The backside layer is mounted with waterproof adhesive to the holding layer. For stabilization, the holding layer can in addition be impregnated with foam material.

BRIEF DESCRIPTION OF THE DRAWINGS

The invention will be described with reference to the accompanying drawing.

DETAILED DESCRIPTION OF PREFERRED EMBODIMENTS

Figure 1:
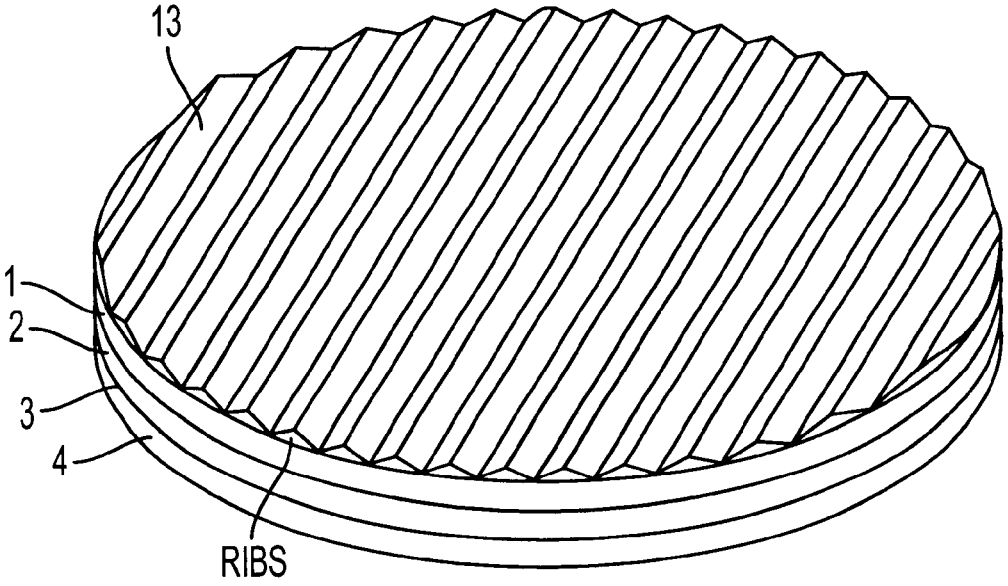
FIG. 1 shows a perspective representation of a polishing disk.
Figure 2:
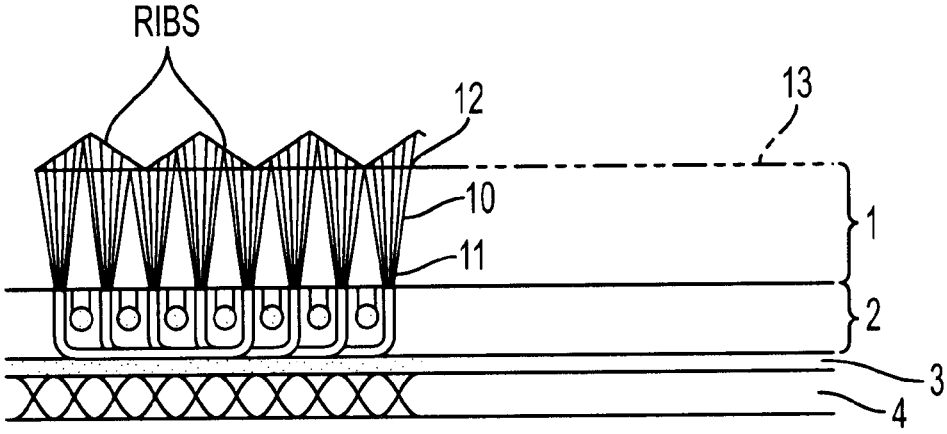
FIG. 2 shows an enlarged detail thereof.

The polishing disk according to the invention has a diameter in the range between 20 and 203 mm, and can be perforated (provided with through openings) or unperforated. The polishing disk is built up of several layers, namely a pile layer 1, a holding layer 2, an adhesive layer 3 and a backside layer 4. The pile layer 1 consists of fibers 10 which extend transversely of the layer, as is known in velvet or velour. The holding layer 2 provides for cohesion, and is constituted as a woven backing or tuft backing. As can be seen from FIG. 2, the fibers 10 can emerge from the holding layer 2 in individual bundles; however, the ends or tips 12 of the individual fibers 10 are arranged relatively uniformly in the polishing plane 13. So that the fibers have a good hold in the holding layer 2, the holding layer can be impregnated with plastic in foam form.

Either by the internal construction of the holding layer or by additional measures, it is insured that the layer 2 of the polishing disk has a certain stiffness and shape stability, i.e., when the polishing disk bends and releases, it returns again to its planar initial position. The flexibility of the polishing disk is however so large that it follows the curvature of the surface to be polished, in order to be able to polish such a surface.

In order to be able to conveniently grip the polishing disk, a fabric layer, for example, a Velcro velour layer or gauze layer of 1 mm thickness, is adhered to the back side of the polishing disk, as shown by the adhesive layer 3 and the back side layer 4. A Velcro hand pad can thereby be installed on the polishing disk, which can be moved by hand. The polishing disk can also be fastened to a backing plate, as provided on a hand polishing machine. The fibers 10 can be natural fibers or plastics fibers. It is important that the fibers are of uniform thickness and do not tend to shed. This also means that the fibers must be relatively resistant to tearing, but however the individual fibers should not be coarse, i.e., they must be at least as thin as given by carpet quality. The fibers or fiber bundles are woven, and the holding layer 2 can be termed a woven back, or the fibers or fiber bundles are tufted into a tufting backing. Due to the quality of the fibers used and their processing, it is possible to wash the polishing disk in a household or industrial washing machine, and thereby to remove dried-on polishing media and polishing dust.

The surface 13 of the polishing disk can be smooth, as illustrated, or can also be ribbed, or structured in other ways. The density of the fiber ends contained in each surface element (rib or groove) should be very high.

The new polishing disk is a multiple use product, because it can be washed. Its structure is sufficiently resilient to be able to follow curvatures of the surface to be polished, but on the other hand is sufficiently firm and stable to withstand a few washing processes without distorting and swelling up.

What is claimed is:

1. A polishing disk for polishing surfaces, comprising:

a pile layer of fibers having free ends, a holding layer for holding the fibers, and a back side layer being entirely flat and determining a disk plane and having a sufficient stiffness for shape stability in the disk plane and sufficient flexibility to adapt to said surfaces to be polished;

said fibers being of a uniform thickness and shed-free and having a length in a range of two to ten millimeters and being anchored in said holding layer and extending transversely to said disk plane, such that the polishing disk is washable without losing said shape stability;

said back side layer being attached to said holding layer with waterproof adhesive and comprising hook and loop fastener means for being attached to a pad or plate.

2. The polishing disk of claim 1, wherein said holding layer comprises a woven backing.

3. The polishing disk of claim 1, wherein said pile layer comprises tufts and said holding layer comprises a tuft backing.

4. The polishing disk of claim 1, wherein said holding layer comprises plastic foam material for stabilizing the holding layer.

5. The polishing disk of claim 1, wherein said free ends of the fibers define a surface which is smooth over a large number of said free ends.

6. The polishing disk of claim 1, wherein said free ends of the fibers defines a rib surface.

7. The polishing disk of claim 1, wherein said disk is circular and defines a disk diameter.

8. The polishing disk of claim 7, wherein said disk diameter is in the range between 20 and 203 mm.

* * * * *